United States Patent [19]

Niida

[11] 4,301,818

[45] Nov. 24, 1981

[54] AUTOMATIC CIGARETTE BUTT EXTINGUISHING DEVICE

[76] Inventor: Kenji Niida, 2-3-17, Nishi, Kunitachi-shi, Tokyo, Japan

[21] Appl. No.: 127,045

[22] Filed: Mar. 4, 1980

[30] Foreign Application Priority Data

Mar. 12, 1979 [JP] Japan ..... 54-29057

[51] Int. Cl.[3] ..... A24F 19/14

[52] U.S. Cl. ..... 131/237

[58] Field of Search ..... 131/237, 256, 231

[56] References Cited

U.S. PATENT DOCUMENTS 2,270,370 1/1942 Dalrymple ..... 131/237

2,558,551 6/1951 Fox ..... 131/237 X 3,522,810 8/1970 Eidson et al. ..... 131/237

*Primary Examiner*—Stephen C. Pellegrino

*Attorney, Agent, or Firm*—Robert F. Ziems

[57] ABSTRACT

The device has a cigarette butt inserting inlet which is operated, as a cigarette butt is inserted, to close a detecting switch to start a cigarette butt extinguishing mechanism which, in turn, close another switch for maintaining the operation of the mechanism in a predetermined time, the mechanism including a drive motor, a series of speed reduction gears, and a pair of adjacent rollers connected by transmission belts to two specific ones of the gears respectively and rotated in the opposite directions at a same speed, and the transmission belts conveying the inserted cigarette butt into between the two rollers.

12 Claims, 8 Drawing Figures

AUTOMATIC CIGARETTE BUTT EXTINGUISHING DEVICE

BRIEF DESCRIPTION OF THE INVENTION

The invention relates to a cigarette butt extinguishing device, and more particularly relates to a device for automatically extinguishing a cigarette butt as it is inserted.

For attaining this object, the present invention substantially comprises a case, a cigarette butt inserting inlet mounted on the case, a cigarette butt extinguishing mechanism located in the case and started to operate by the detecting switch, and a switch maintaining the operation of the mechanism for a predetermined time, said mechanism including an electric drive motor electrically connected to the detecting switch, a series of gears operatively connected to the drive motor and driven at a reduced speed, a pair of adjacent rollers connected to two specific ones of the gears respectively by two transmission belts which transmit the rotational movements of the two gears to the rollers and also convey the inserted cigarette butt into between the two rollers.

So far various cigarette butt disposing instruments have been provided, such as the ash trays containing water, sands or gravels, or such as the ones with a cover. These instruments are, however, all incomplete to put out the cigarette butts, and often cause smoke and reluctant smell effecting an air polusion in the room and an adverse influence to the breathing organ. Such phenomena are not only unpleasant and unhealthy, but also dangerous to the prevention of a fire. Further such cigarette butt disposing instruments must be cleaned up so often since these are conspicuous of dirtiness.

The present invention has been provided to eliminate such defects and disadvantages of the prior art.

It is a primary object of the invention to provide a compact and firm cigarette butt extinguishing device which is automatically operated, as a cigarette butt is inserted, to extinguish the latter.

It is another object of the invention to provide a cigarette butt extinguishing device which requires no water or sands.

It is another object of the invention to provide a cigarette butt extinguishing device which is safely operated, even if something different is inserted.

It is another object of the invention to provide a cigarette butt extinguishing device which is easily cleaned up.

It is another object of the invention to provide a cigarette butt extinguishing device which absolutely prevents a fire.

It is another object of the invention to provide a cigarette butt extinguishing device which is operated to apply a pressure an inserted cigarette butt to completely extinguish the same.

It is still another object of the invention to provide a cigarette butt extinguishing device which may be produced in various sizes and various configurations in dependence upon the places in which it is to be used.

The other features and advantages of the invention will be apparent from the following description of the preferred embodiments in reference to the attached drawings.

DETAILED DESCRIPTION OF THE INVENTION

Figure 1:
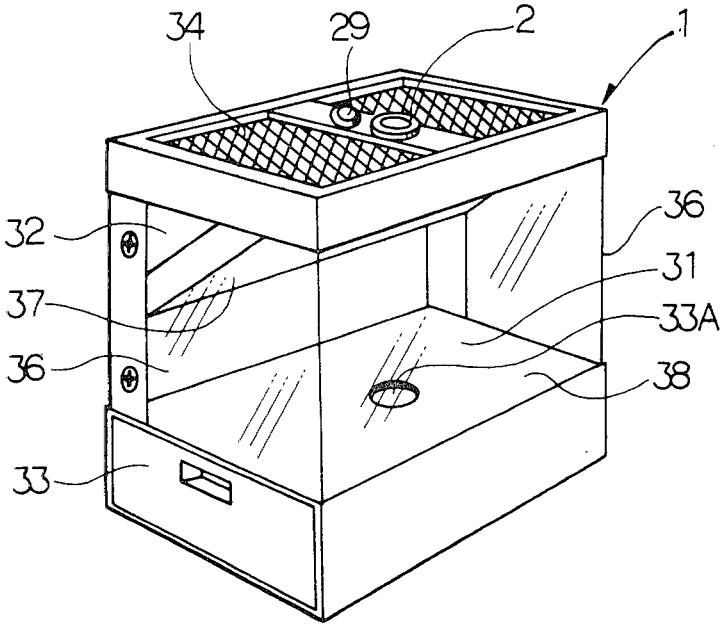
FIG. 1 is a perspective view of a case of this invention.
Figure 2:
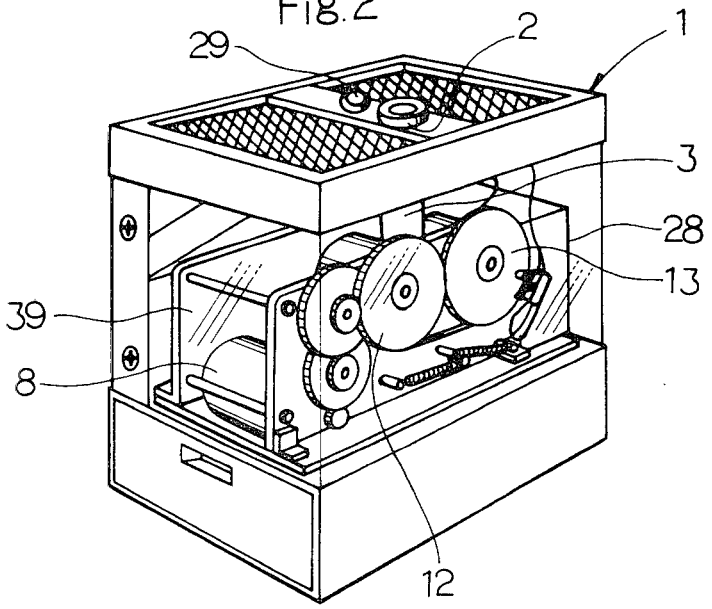
FIG. 2 is a perspective view of the case containing therein a cigarette butt extinguishing mechanism of the invention.
Figure 3:
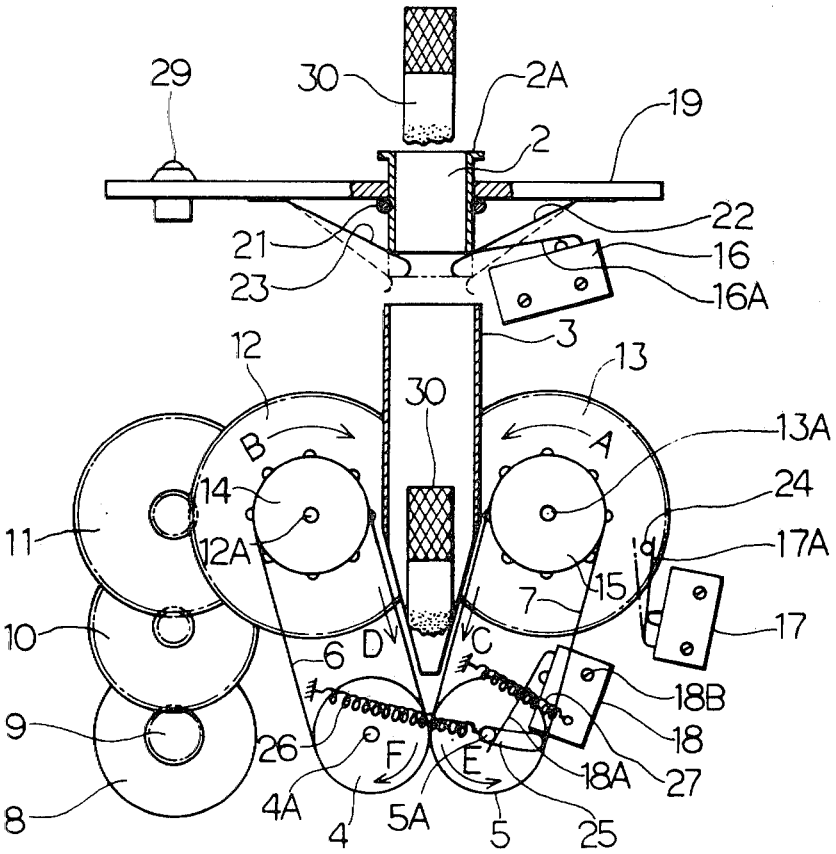
FIG. 3 is a front elevational view of the cigarette butt extinguishing mechanism of the invention partly shown in a vertical section.
Figure 4:
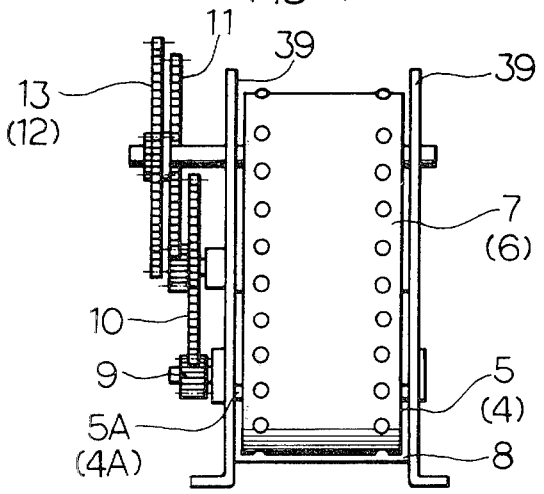
FIG. 4 is a side elevational view of a transmission part of the cigarette butt extinguishing mechanism.
Figure 5:
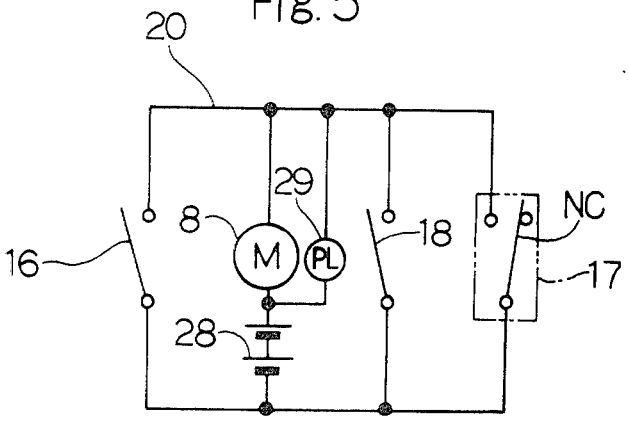
FIG. 5 is a diagramatic representation of a control circuit for the cigarette butt extinguishing mechanism.

In reference to FIGS. 1 and 2, the reference numeral 1 denotes a box-type case, which is provided, at the top face thereof, with a cigarette butt inserting inlet 2, a pilot lamp 29 and a network which is rigid as well as fireproofed. As shown the case has a chamber 31 for a cigarette butt extinguishing mechanism, and an ash tray 33 provided below the mechanism chamber 31 and is drawn out of the case 1. The cigarette butt extinguishing mechanism is, as shown in FIGS. 3 and 4, substantially consists of the cigarette butt inserting inlet 2, a vertical guide tube 3 provided in alignment with the inlet 2, a set of pressing rollers 4, 5, a set of cigarette guide belts 6, 7, an electric motor 8 to drive the mechanism, a series of speed reducing gears 9–13, a set of belt wheels 14, 15 and microswitches 16–18. The extinguishing mechanism is mounted on a support plate 39 as shown in FIG. 2 and automatically controlled by an electric circuit 20 as shown in FIG. 5. As particularly shown in FIG. 6, the mechanism chamber 31 shielded from the rest of the case 1 by an upper rearwardly inclined wall 37 and vertical wall 37A which is spaced from the rear wall 35 of the case 1. Thus the shielded space 32 of the case is continuous to the upper opening of the ash tray 33.

As shown in FIG. 3, the cigarette butt inserting inlet 2 is a tube element and is vertically slidable on a support 19. The tube element 2 is formed with a flange 2A at the top thereof to prevent this element from being dropped into the case 1 when it is depressed. A ring 21 is amounted around the tube element 2 at the underside of the support 19 to limit the upper movement of this element as this is normally biased in the upper direction by a pair of plate springs 22, 23 which are each secured, at one end thereof, to the underside of the support 19. If the inlet tube element 2 is manually depressed against the action of the springs 22, 23 to the position as shown by an imaginary line, the springs 22, 23 are outwardly displaced to the positions as shown by the imaginary lines, thereby to allow the drop of a cigarette butt 30 therethrough into the guide tube 3. In the meantime, the lower end of the inlet tube element 2 depresses an actuator 16A of a microswitch 16, provided on one side of the inlet tube element 2, to start the electric motor 8. If the electric motor 8 is driven, a pair of gears 12, 13 at the last stage of the series of gears 9–13, which are operated in association with the electric motor 8, are rotated on the central axes 12A, 13A at a predetermined reduced speed (about one rotation in 16 seconds) in the directions opposite to each other as indicated by the arrow marks A, B respectively. The gears 12, 13 are coaxially provided with belt wheels 14, 15 respectively for rotation therewith.

As shown, below the gears 12, 13, a pair of pressing rollers 4, 5 are arranged with the central axes 4A, 5A respectively. A guide belt 6 is wound around the belt wheel 14 and the pressing roller 4 and another guide belt 7 is wound around the belt wheel 15 and the pressing roller 5 is such a manner that the guide faces of the two guide belt 6, 7 from a V shaped guide passage. These guide belts 6, 7 are made of a phospher bronze or other inconbustible materials, as the belts are operated to press a cigarette butt 30 dropped from the guide tube 3, in cooperation with the pressing belts 4, 5. These guide belts 6, 7 are moved in the directions indicated by the arrow marks C, D respectively by the sprocket belt wheels 14, 15. As a result, the pressing rollers 4, 5 are rotated at a same speed in the opposite directions as indicated by the arrow marks E, F. As shown, a pin 24 is provided on the front side of the gear 13, which is for detecting one complete rotation of the gear 13 and is normally in engagement with an actuator 17A of a microswitch 17 to maintain the latter in an opened condition. As the gear 13 is rotated and the pin 24 is disengaged from the actuator 17, the actuator 17A is operated to close the microswitch 17 and maintains the drive of the electric motor 8 to secure one complete rotation of the gears 12, 13 and therefore one complete rotation of the guide belts 14, 15 and the pressing rollers 4, 5. For attaining this object, the microswitch 17 is of a normally closed contact.

The pressing roller 4 is positionally fixed. On the other hand, the other pressing roller 5 is displacable around the axis 13A of the belt wheel 15 along an arc shaped guide slot 25 which is engaged by the center axis 5A of the pressing roller 5. The pressing roller 5 is normally pressed against the pressing roller 4 by a tension spring 26 connected to the center axis 5A of the roller 5. If a cigarette butt 30 or other thing is carried into between the two pressing rollers 4, 5, the roller 5 is wholly displaced around the axis 13A of the gear 13 against the action of the spring 26 in dependence upon the thickness of the loads passing between the rollers 4, 5. As a result, the axis 5A of the roller 5 depresses an actuator 18A of a microswitch 18 which is, at one end thereof, turnably mounted by a pivot 18B on the support 39 and is biased by a tension spring 27 in the clockwise direction as shown. Thus the actuator 18A is depressed to close the microswitch 18 to drive the motor 8 irrespectively of the other microswitches 16, 17. For reader's convenience, FIG. 3 shows the guide belts 6, 7 and the pressing rollers 4, 5 on the front side of the gears 12, 13. Actually these elements are all arranged on the rear side of the gears 12, 13 and can not be seen from the front side of the case 1 as shown in FIG. 2.

The electric circuit for controlling the operation of the cigarette butt extinguishing mechanism is, as shown in FIG. 5, composed of a series line of a power source and the motor 8, and the pilot lamp 29 of a light emitting diode, and the microswitches 16–18, each arranged in parallel to the series line of the power source and the motor.

Figure 6:
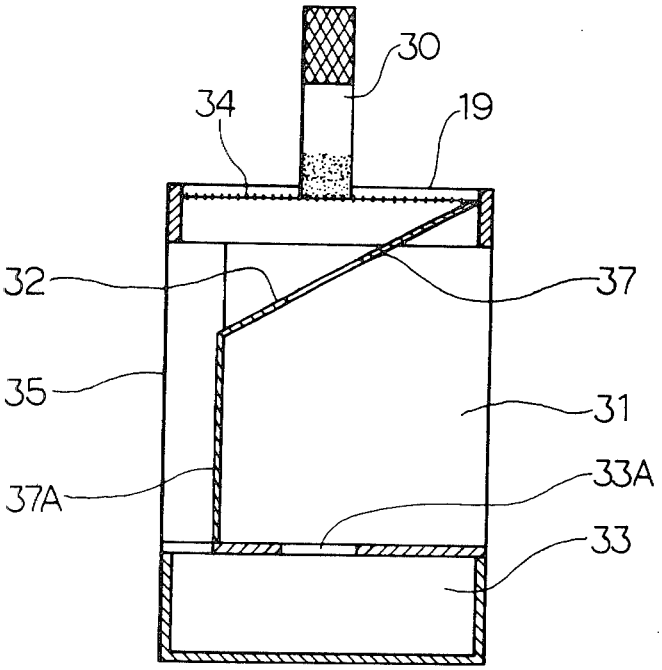
FIG. 6 is a side elevational view of the case shown in a vertical section.

The cigarette butt extinguishing mechanism including the control circuit is placed in the mechanism chamber 31 of the case 1 as shown in FIG. 2. As shown in FIG. 6, the ashes scraped off from a cigarette at the network 34 are dropped onto the rearwardly inclined upper wall 37 of the mechanism chamber 31 and slide down into the lower drawer-type ash tray 33 through the channel defined by the vertical wall 37A of the mechanism chamber and the rear wall 35 of the case 1. The ash tray 33 is drawn out from the case to be cleaned up. The mechanism chamber 31 is covered by a molded transparent frame, and the inner face of the upper shield plate 37 is polished up like a mirror so that the inner mechanism and the cigarette butt extinguishing operation thereof may be observed from the front 38 and both sides of the case 1. As a power source, a set of dry cells are placed on one side of the mechanism in the chamber 31, though these are not shown. As is understood from FIG. 5, the pilot lamp 29 is lighted during the cigarette butt extinguishing operation of the mechanism, and the lamp is put out to indicate that the cigarette butt extinguishing operation has been finished. A music box may be employed to indicate the operation of the mechanism. Further, the case 1 may be so formed as to provide a lighter.

With the above mentioned structure and mechanism, the operation of the invention is as follows: If the user of the cigarette butt extinguishing case depresses the inlet element 2 against the action of the plate springs 22, 23 as the user inserts the cigarette butt 30 into the inlet element, the spring 22 is displaced to close the microswitch 16, thereby to start the electric motor 8, and simultaneously the cigarette butt is dropped into the guide tube 3. As the motor 8 is driven, the series of speed reducing gears 9–13 are rotated, and a circuit of the motor 8, the power source 28 and the microswitch 17 becomes conductive as the pin 24 on the gear 13 departs from the normally closed microswitch 17. The motor 8, therefore, drives the gears 12, 13 until these gears make one complete rotation, even if the inlet element 2 is returned back in the upper inoperative position and the microswitch 16 is opened. Accordingly the pressing rollers 4, 5 are rotated by way of the guide belts 6, 7 until the gears 12, 13 are stopped. In the meantime, the cigarette butt 30 is carried down between the pressing rollers 4, 5 by the V shaped path of the two guide belts 6, 7, and is completely extinguished by the pressure of the two rollers 4, 5. The extinguished cigarette butt 30 is dropped into the lower ash tray 33 through an opening 33A of the bottom wall of the mechanism chamber 31. If a longer cigarette butt or something different is inserted, the roller 5 is outwardly displaced to close the microswitch 18, thereby to maintain the rotation of the motor 8 irrespectively of the microswitch 17 until such a longer object is dropped into the lower ash tray 33. If something thick and rigid is inserted, the microswitch itself 18 is outstanding displaced against the action of the tension spring 27 until the inserted object is dropped into the ash tray 33. Then the roller 5 is returned to the original position by the tension spring 26 and the microswitch 18 is opened. In any case, however, the current to the motor 8 is finally shut out when the pin 24 of the gear 13 comes to the position to open the normally closed microswitch 17.

Figure 7:
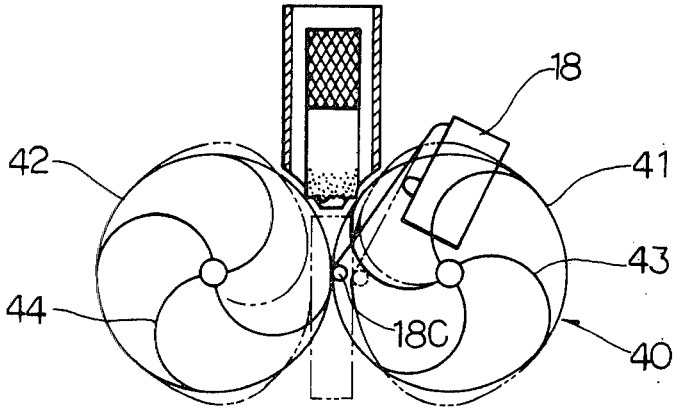
FIG. 7 is a front elevational view of another embodiment of the invention partly shown in a vertical section.

FIG. 7 shows another embodiment of the invention, in which the belts 6, 7 and the pressing rollers 4, 5 are replaced by a pair of elastic rings 41, 42 with respective spokes 43, 44 coaxially mounted with the respective gears 12, 13 for rotation therewith. The ring 41 is made partly broader and the broader part is engaged by the free end of the actuator 18C of the microswitch 18. In this embodiment, the ring 41 yields due to a passing load to operate the actuator 18C, thereby to close the microswitch 18.

Figure 8:
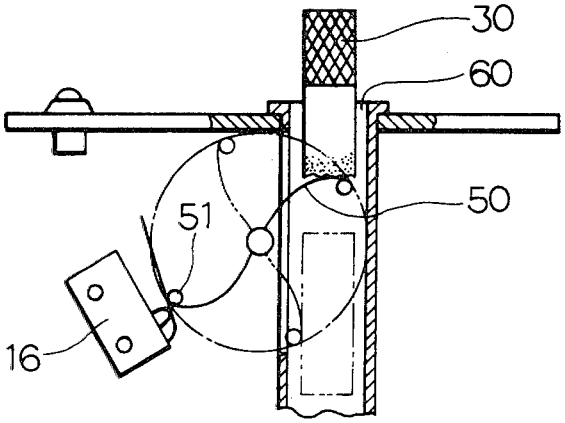
FIG. 8 is a front elevational view of still another embodiment of the invention partly shown in a vertical section.

FIG. 8 shows still another embodiment of the invention, in which the cigarette butt inserting inlet element 50 is fixedly arranged, and the actuator 50 of the microswitch 16 is rotatable and extends across the path of the cigarette butt 30. Thus the actuator 50 is rotated to close and open the microswitch 16 when the cigarette butt 30 is inserted into the inlet 60. The actuator 50 may be brought into the operative position as shown, after the cigarette butt 30 has been passed away, by utilizing the drive of the motor 8.

Since the invention uses no relay elements in the control circuit, the power consumption is considerably prevented. By the test of the working sample, it has been found out that the product of the invention with two dry cells of SUM-1/1.5V will operate for a half to one year even if it extinguishes two hundred pieces of cigarette butts a day.

The embodiments of the invention are of a small and portable type to be used on a table. The embodiments may, however, be modified into various types, in dependence upon the usage, such as a stand type, a car type, etc,. The stand type may be converted to the A.C. power source, and the car type may be connected to the battery power source of the car.

According to the invention, the consumption of electric power is prevented, and the electric power is considerably saved especially by employing a series of spur gears 9–13 as the substantial elements of the cigarette extinguishing mechanism to be driven by the motor 8. Instead, the motor 8 may drive a worm gear to reduce the speed reduction ratio, thereby to reduce the number of reduction gears. This, however, is not so preferable, because such a mechanism includes a load thrusting operation of the worm gear which consumes much power.

I claim:

1. An automatic cigarette butt extinguishing device comprising a case; a cigarette butt inserting inlet means mounted on the case; cigarette butt extinguishing means located in the case; means detecting a cigarette butt inserted into the cigarette butt inserting means to start the cigarette butt extinguishing means; and electrical circuit means responsive to said detecting means for maintaining the operation of the cigarette butt extinguishing means until the latter extinguishes the cigarette butt.

2. An automatic cigarette butt extinguishing device as defined in claim 1, wherein said cigarette butt extinguishing means includes an electric motor started by the detecting means when the latter detects the cigarette butt, a series of gears which are operated in association with the electric motor, and a pair of rollers which are rotated in association with the series of gears to press the cigarette butt, and wherein said circuit means includes a power source and an operation maintaining switch which is closed, when the series of gears are started, to energize the electric motor by way of the power source for a predetermined time.

3. An automatic cigarette butt extinguishing device as defined in claim 2, further comprising a pair of belts, and wherein at least two of the series of gears are rotated in opposite directions at a same speed and each has a coaxial belt wheel, said belts being each wound around the first belt wheel and the first roller and the second belt wheel and the second roller respectively to transmit the rotation of the gears to the rollers in such a manner that the two belts form a V shaped path for conveying the cigarette butt between the two rollers.

4. An automatic cigarette butt extinguishing device as defined in claim 2, further comprising a switch which is closed by one of the rollers when the cigarette butt is conveyed between the two rollers, thereby to supply a power from the power source to the electric motor irrespectively of the operation maintaining switch until the cigarette butt is passed away.

5. An automatic cigarette butt extinguishing device as defined in claim 4, wherein said one of the rollers is radially displaced by a load coming into between the two rollers, thereby to close said switch.

6. An automatic cigarette butt extinguishing device as defined in claim 4, wherein said two rollers are made of an elastic material and elastically yield by a load coming into therebetween to close said switch.

7. An automatic cigarette butt extinguishing device as defined in claim 1, wherein said cigarette butt inserting inlet means includes a tubed element guiding the inserted cigarette butt, said guide element being movable as the cigarette butt is inserted thereinto, and wherein said detecting means includes a starting switch which is closed by the movement of the guide element to start the cigarette butt extinguishing means.

8. An automatic cigarette butt extinguishing device as defined in claim 1, wherein said cigarette butt inserting inlet means includes a tubed element fixedly mounted on the case, and wherein said detecting means includes a starting switch which is closed to start the cigarette butt extinguishing means and a rotatable element engaged by the inserted cigarette butt to rotate to close the starting switch.

9. An automatic cigarette butt extinguishing device as defined in claim 1, wherein said cigarette butt extinguishing means includes a plurality of speed reducing gears, at least two of which being rotated in the opposite directions at a same speed and at least two pressing rollers of elastic material which are coaxially mounted with the two gears, said pressing rollers elastically yielding by a load coming into therebetween, and wherein said maintaining circuit means includes a switch closed by one of the elastic pressing rollers, as the load comes, to maintain the operation of the cigarette butt extinguishing means until the cigarette butt passes away.

10. An automatic cigarette butt extinguishing device as defined in claim 1, wherein said case is composed of an upper network, front and rear walls, opposite side walls each connected to the upper network and a bottom wall connected to the front and rear walls and to the opposite side walls, said case having a chamber for the cigarette butt extinguishing means, which is shielded from the other space of the case by an inclined wall and a vertical wall, and a vessel removably attached to the underside of the bottom wall, said bottom wall having an opening for providing a channel, together with the rear wall and the vertical wall, connecting the other space of the case to the lower vessel.

11. An automatic cigarette butt extinguishing device as defined in claim 10, wherein said front wall and the opposite side walls are made of a transparent material.

12. An automatic cigarette butt extinguishing device as claim 10, wherein said case is partly covered by a transparent material.

* * * * *